US011293632B2

(12) United States Patent
Du et al.

(10) Patent No.: US 11,293,632 B2
(45) Date of Patent: Apr. 5, 2022

(54) LAMP AND LIGHT SOURCE SUBSTRATE THEREOF

(71) Applicant: Shenzhen Fluence Technology PLC., Shenzhen (CN)

(72) Inventors: Jianjun Du, Shenzhen (CN); Wei Wang, Shenzhen (CN); Juan Li, Shenzhen (CN); Jun Wang, Shenzhen (CN)

(73) Assignee: SHENZHEN FLUENCE TECHNOLOGY PLC, Shenzhen (CN)

( * ) Notice: Subject to any disclaimer, the term of this patent is extended or adjusted under 35 U.S.C. 154(b) by 593 days.

(21) Appl. No.: 16/308,819

(22) PCT Filed: Dec. 29, 2017

(86) PCT No.: PCT/CN2017/120245
§ 371 (c)(1),
(2) Date: Dec. 11, 2018

(87) PCT Pub. No.: WO2019/127515
PCT Pub. Date: Jul. 4, 2019

(65) Prior Publication Data

US 2021/0222862 A1 Jul. 22, 2021

(51) Int. Cl.
*F21V 29/00* (2015.01)
*F21V 29/60* (2015.01)
(Continued)

(52) U.S. Cl.
CPC ..... *F21V 29/60* (2015.01); *F21K 9/232* (2016.08); *F21V 17/16* (2013.01); *F21V 29/83* (2015.01);
(Continued)

(58) Field of Classification Search
CPC ..... F21V 29/83; F21V 29/60; F21V 17/16
See application file for complete search history.

(56) References Cited

U.S. PATENT DOCUMENTS

2006/0193130 A1* 8/2006 Ishibashi ..... F21V 29/67 362/227
2009/0059559 A1* 3/2009 Pabst ..... F21V 29/67 362/84
(Continued)

FOREIGN PATENT DOCUMENTS

CN 203454060 U 2/2014
CN 203671346 U 6/2014
(Continued)

OTHER PUBLICATIONS

International Search Report on corresponding PCT application (PCT/CN2017/120245) from International Searching Authority (CN) dated Dec. 29, 2017.

*Primary Examiner* — Gerald J Sufleta, II

(57) ABSTRACT

The present disclosure provides a lamp and a light source substrate thereof. The lamp includes a receiving body, an assembling stand, a light source substrate, and a lamp head. The receiving body includes a lamp cover and a cover body, the lamp cover is provided with an open end. The assembling stand is inserted into the lamp cover through the open end, and the assembling stand is used for assembling a power module and receiving a fan. The light source substrate is electrically connected to the power module. The light source substrate includes a plurality of end-surface LED substrates and a plurality of side-surface LED substrates. The plurality of end-surface LED substrates and the plurality of side-surface LED substrates are bent and enclosed to form a cylindrical light emitting body and clamp with the assembling stand. The lamp head mates with the cover body.

17 Claims, 10 Drawing Sheets

(51) Int. Cl.

| | |
|---|---|
| ***F21V 29/83*** | (2015.01) |
| ***F21K 9/232*** | (2016.01) |
| ***F21V 17/16*** | (2006.01) |
| *F21Y 107/30* | (2016.01) |
| *F21Y 107/40* | (2016.01) |
| *F21Y 115/10* | (2016.01) |

(52) U.S. Cl.
CPC ..... *F21Y 2107/30* (2016.08); *F21Y 2107/40* (2016.08); *F21Y 2115/10* (2016.08)

(56) References Cited

U.S. PATENT DOCUMENTS

2011/0298371 A1* 12/2011 Brandes ..... F21K 9/23 315/32
2012/0049732 A1* 3/2012 Chuang ..... F21K 9/232 315/32
2014/0247606 A1* 9/2014 Chen ..... F21K 9/90 362/363
2016/0066374 A1* 3/2016 Shen ..... F21K 9/23 315/291
2017/0234521 A1* 8/2017 Yeung ..... F21K 9/238 362/296.01
2018/0112833 A1* 4/2018 Cao ..... F21V 29/89
2018/0245785 A1* 8/2018 Deng ..... F21V 29/70
2018/0372276 A1* 12/2018 Su ..... F21V 23/003
2020/0132257 A1* 4/2020 Hong ..... F21V 23/06

FOREIGN PATENT DOCUMENTS

| | | | |
|---|---|---|---|
| CN | 205938586 | U | 2/2017 |
| CN | 206159862 | U | 5/2017 |
| CN | 106989294 | A | 7/2017 |
| CN | 107062009 | A | 8/2017 |
| CN | 206545906 | U | 10/2017 |
| CN | 107388062 | A | 11/2017 |
| CN | 206637295 | U | 11/2017 |
| CN | 108317409 | A | 7/2018 |
| JP | 2016115649 | A | 6/2016 |
| JP | 2016119228 | A | 6/2016 |
| WO | WO2014069183 | A1 | 5/2014 |

* cited by examiner

LAMP AND LIGHT SOURCE SUBSTRATE THEREOF

CROSS-REFERENCE TO RELATED APPLICATIONS

The present application is a continuation-application conversion of International (PCT) Patent Application No. PCT/CN2017/120245 filed Dec. 29, 2017.

TECHNICAL FIELD

The present disclosure generally relates to a light emitting device, and more particularly, to a lamp and a light source substrate thereof.

BACKGROUND

A light emitting diode (LED) is a semiconductor device that converts electricity into visible light. The LED is energy efficient and environmental friendly, and thus has become a major trend in the development of lamp industry. The working temperature of the LED has a direct impact on its service life. Therefore, heat dissipation of the LED is very important.

In some lamps (e.g. light bulbs), a fan is provided inside the lamp to cool a light emitting body. However, the existing light emitting body is complicated to manufacture and the assembly by way of welding is inconvenient.

SUMMARY

An aspect of the present disclosure includes a lamp comprising a receiving body, which includes a lamp cover and a cover body, wherein the lamp cover is provided with a first gas port, the cover body is provided with a second gas port, and the lamp cover is provided with an open end. An assembling stand may be inserted into the lamp cover through the open end, wherein the assembling stand is used for assembling a power module and receiving a fan.

A light source substrate may be electrically connected to the power module, wherein the light source substrate comprises a plurality of end-surface LED substrates and a plurality of side-surface LED substrates integrally connected to a side of the plurality of end-surface LED substrates, and the plurality of end-surface LED substrates and the plurality of side-surface LED substrates are bent and enclosed to form a cylindrical light emitting body and clamp with the assembling stand.

A lamp head may mate with the cover body.

According to a specific embodiment of the present disclosure, each of the plurality of end-surface LED substrates is shaped like a triangle with a sector region removed from the triangle, wherein an angle of the triangle is taken as a central angle of the sector region, and the plurality of end-surface LED substrates are bent and enclosed to form a central assembly hole.

According to a specific embodiment of the present disclosure, an outer end of the lamp cover is integrally formed with an embedded type downlight fitting to the central assembly hole, the first gas port is arranged on the embedded type downlight, and the cylindrical light emitting body sleeves and abuts against the embedded type downlight through the central assembly hole.

According to a specific embodiment of the present disclosure, each of the plurality of side-surface LED substrates is shaped like a rectangle or a trapezoid.

According to a specific embodiment of the present disclosure, the plurality of side-surface LED substrates are seamlessly connected to each other and are enclosed to form an airflow channel, and the power module is positioned in the airflow channel.

According to a specific embodiment of the present disclosure, the plurality of side-surface LED substrates are provided with a plurality of first clasp holes used for clasping and fixing the assembling stand.

According to a specific embodiment of the present disclosure, an end portion of the plurality of side-surface LED substrates are provided with a plurality of die-cutting holes, a plurality of clamp substrates extend in the plurality of die-cutting holes, and the plurality of first clasp holes are arranged on the plurality of clamp substrates.

According to a specific embodiment of the present disclosure, an end portion of the side-surface LED substrate is provided with a die-cutting slot, an electric contact element extends in the die-cutting slot, and the electric contact element is used for bending with respect to the side-surface LED substrate to form an electric connection at an end portion of the cylindrical light emitting body.

According to a specific embodiment of the present disclosure, both the plurality of end-surface LED substrates and the plurality of side-surface LED substrates comprise an aluminum substrate and a plurality of LEDs arranged on the aluminum substrate.

According to a specific embodiment of the present disclosure, the lamp further comprises a power supply support, and the power module is fixed to the assembling stand via the power supply support.

According to a specific embodiment of the present disclosure, the power supply support comprises a bottom plate and a lateral plate, the bottom plate is used for fixing the assembling stand, the lateral plate is vertically arranged with respect to the bottom plate, a backup plate extends on the lateral plate, the backup plate is provided with a fastening hole used for receiving a bolt and fastening the power module.

According to a specific embodiment of the present disclosure, the assembling stand comprises an air duct, with the fan received in the air duct, a plurality of first snap buckles arranged on an outer ring of the air duct, wherein the plurality of first snap buckles are used for clamping and connecting the cylindrical light emitting body, a plurality of second snap buckles arranged on the outer ring of the air duct, wherein the plurality of second snap buckles are used for clamping and connecting the lamp cover, and a plurality of third snap buckles arranged on the outer ring of the air duct, wherein the plurality of third snap buckles are used for clamping and connecting the cover body.

According to a specific embodiment of the present disclosure, an inner side of the plurality of first snap buckles is provided with a barricade. The barricade forms a sleeve clearance with the plurality of first snap buckles to sleeve the cylindrical light emitting body.

According to a specific embodiment of the present disclosure, the barricade is shaped like a regular polygon and is used for supporting a plurality of side-surface LED substrates, and the barricade is further provided with a plurality of insertion pieces fitting to the plurality of die-cutting holes.

According to a specific embodiment of the present disclosure, the lamp cover is provided with a plurality of second clasp holes fitted to the plurality of second snap buckles, and the cover body is provided with a plurality of lift tables fitted to the plurality of third snap buckles.

To solve the above technical problem, the present disclosure adopts another technical solution as below. The light source substrate includes a plurality of end-surface LED substrates and a plurality of side-surface LED substrates integrally connected to a side of the plurality of end-surface LED substrates, wherein the plurality of end-surface LED substrates and the plurality of side-surface LED substrates are bent and enclosed to form a cylindrical light emitting body having a central assembly hole.

According to a specific embodiment of the present disclosure, each of the plurality of side-surface LED substrates is provided with a first clasp hole used for clasping and fixing.

Different from the related art, the lamp and the light source substrate thereof according to the present disclosure are simple in structure, have improved heat dissipation, simpler in manufacturing, and easy to assemble. Therefore, production difficulties and costs are greatly reduced.

BRIEF DESCRIPTION OF THE DRAWINGS

To describe the technical solutions in the embodiments of the present disclosure more clearly, the accompanying drawings required for describing the embodiments will be briefly introduced below. Apparently, the accompanying drawings in the following description are merely some embodiments of the present disclosure. To those of ordinary skills in the art, other accompanying drawings may also be derived from these accompanying drawings without creative efforts. In the accompanying drawings.

DETAILED DESCRIPTION

Technical solutions in the embodiments of the present disclosure will be described clearly and completely below with reference to the accompanying drawings in the embodiments of the present disclosure. Apparently, the described embodiments are some but not all of the embodiments of the present disclosure. All other embodiments obtained by a person of ordinary skill in the art based on the embodiments of the present disclosure without creative efforts shall fall within the protection scope of the present disclosure.

Referring to FIGS. 1-4, an embodiment of the present disclosure provides a lamp 10, which may include a receiving body, an assembling stand 200, a light source substrate 300, and a lamp head 400.

Figure 1:
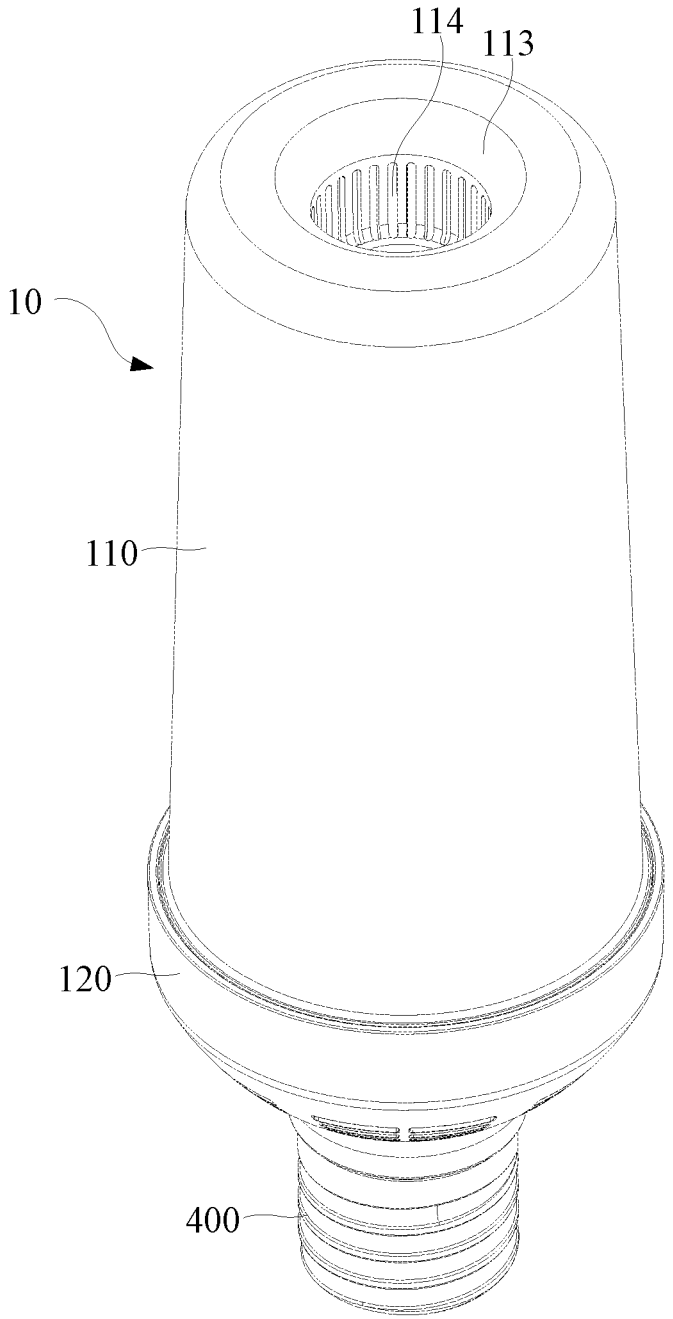
FIG. 1 is a tridimensional schematic structural view of a lamp in a first angle of view according to a embodiment of the present disclosure.
Figure 2:
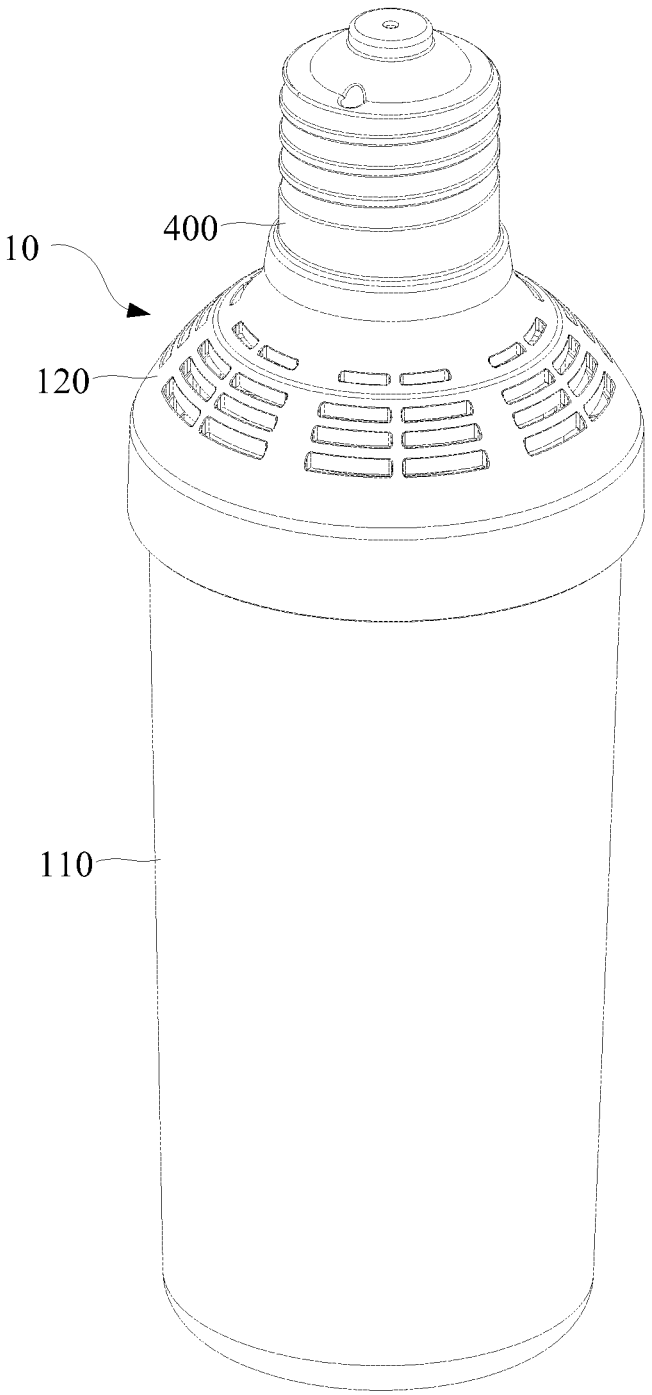
FIG. 2 is a tridimensional schematic structural view of a lamp in a second angle of view according to a embodiment of the present disclosure.
Figure 3:
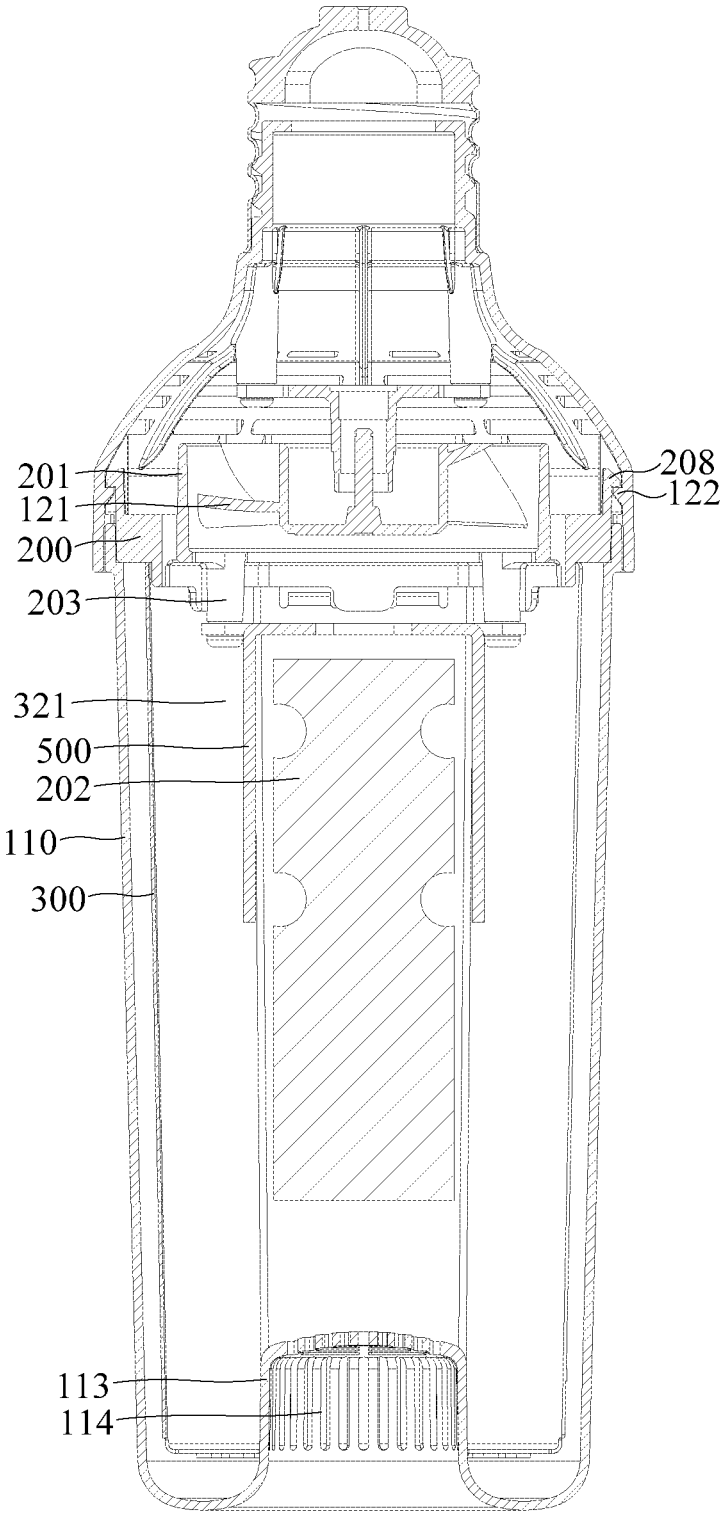
FIG. 3 is a schematic structural view of a cross section of the lamp as shown in FIG. 1.
Figure 4:
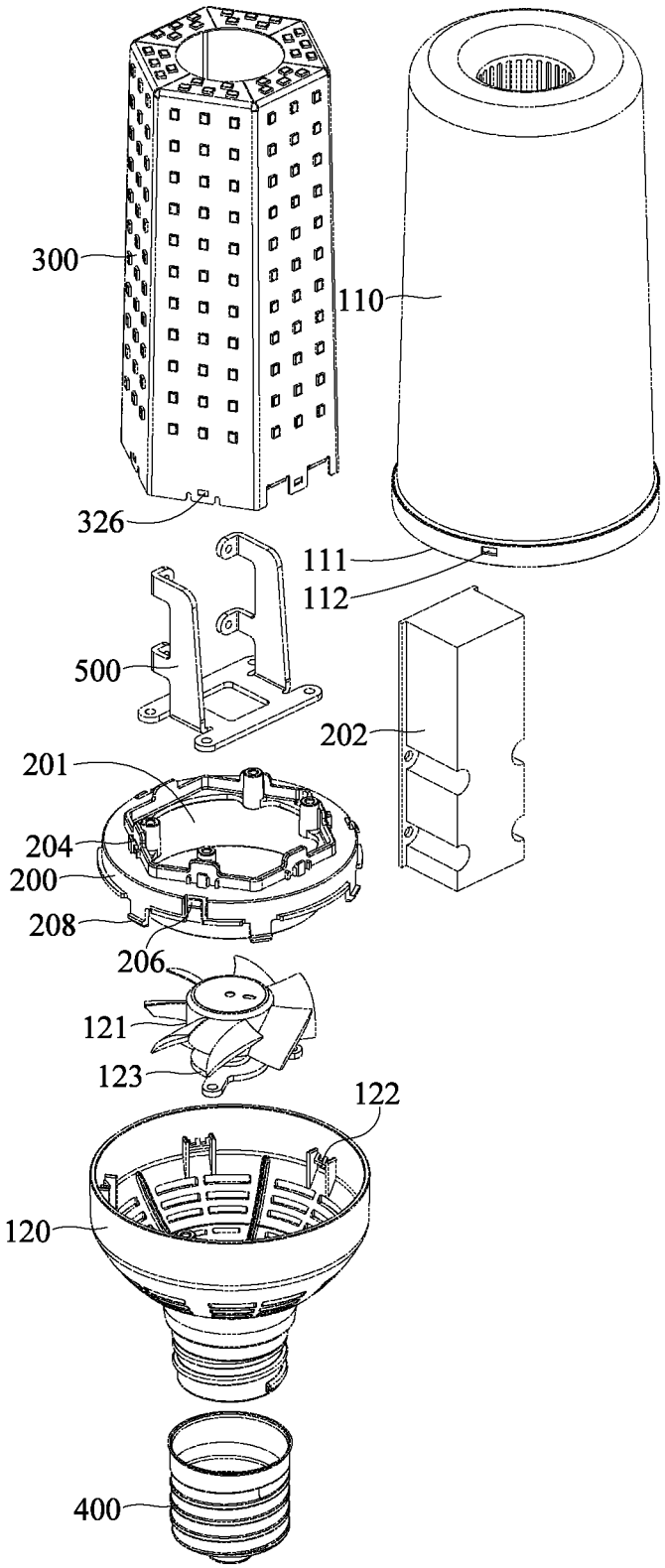
FIG. 4 is an exploded structural view of the lamp as shown in FIG. 1.

As shown in FIG. 4, the receiving body may include a lamp cover 110 and a cover body 120. The lamp cover 110 may be provided with a first gas port 114, the cover body 120 may be provided with a second gas port 126, and the lamp cover 110 may be provided with an open end 111. The lamp cover 110 and the cover body 120 may be integrally molded by transparent or translucent materials such as glass materials or plastic materials.

The assembling stand 200 may be inserted into the lamp cover 110 through the open end 111, and the assembling stand 200 may be used for assembling a power module 202 and receiving a fan 121. The assembling stand 200 may be integrally molded by plastic materials.

Figure 5:
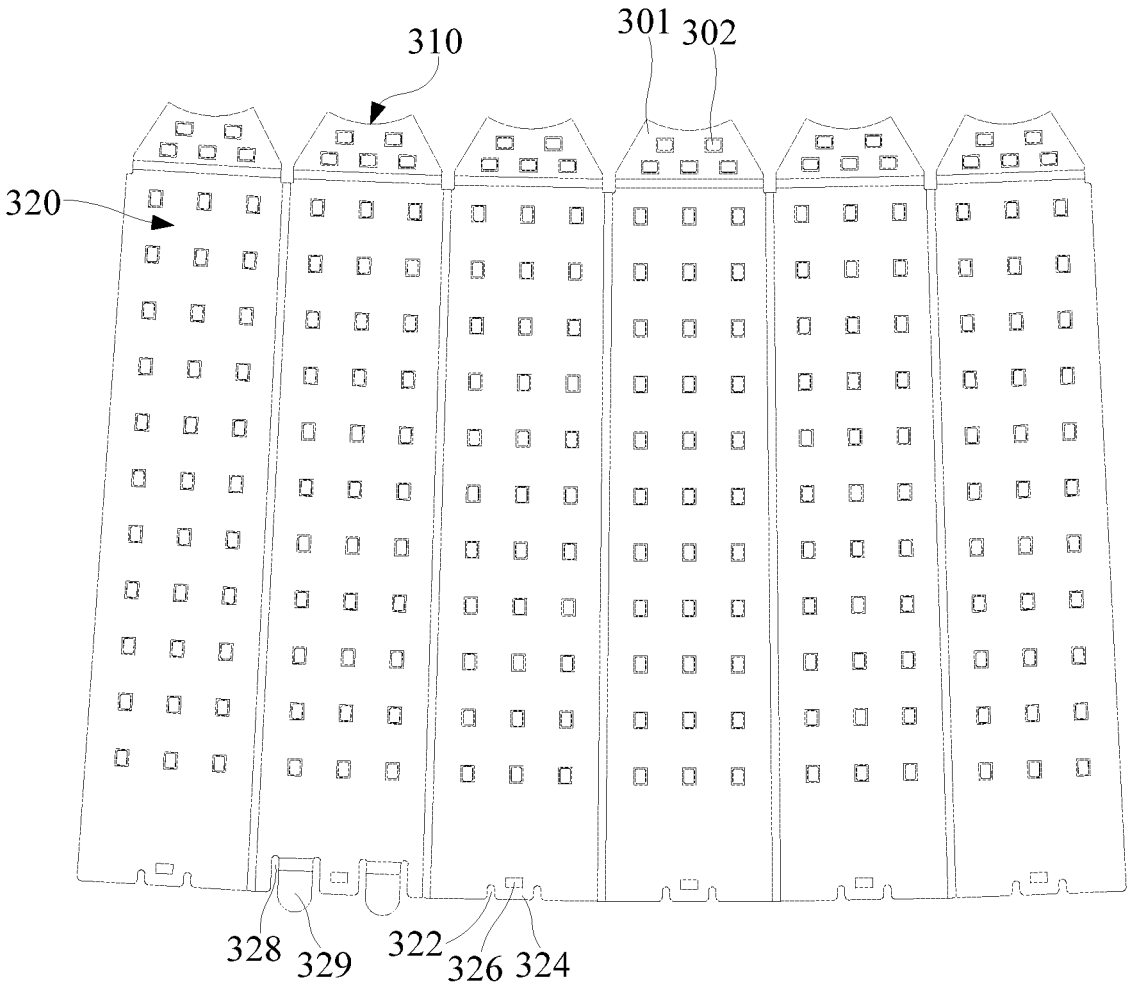
FIG. 5 is a schematic structural view of a light source substrate according to a embodiment of the present disclosure.
Figure 6:
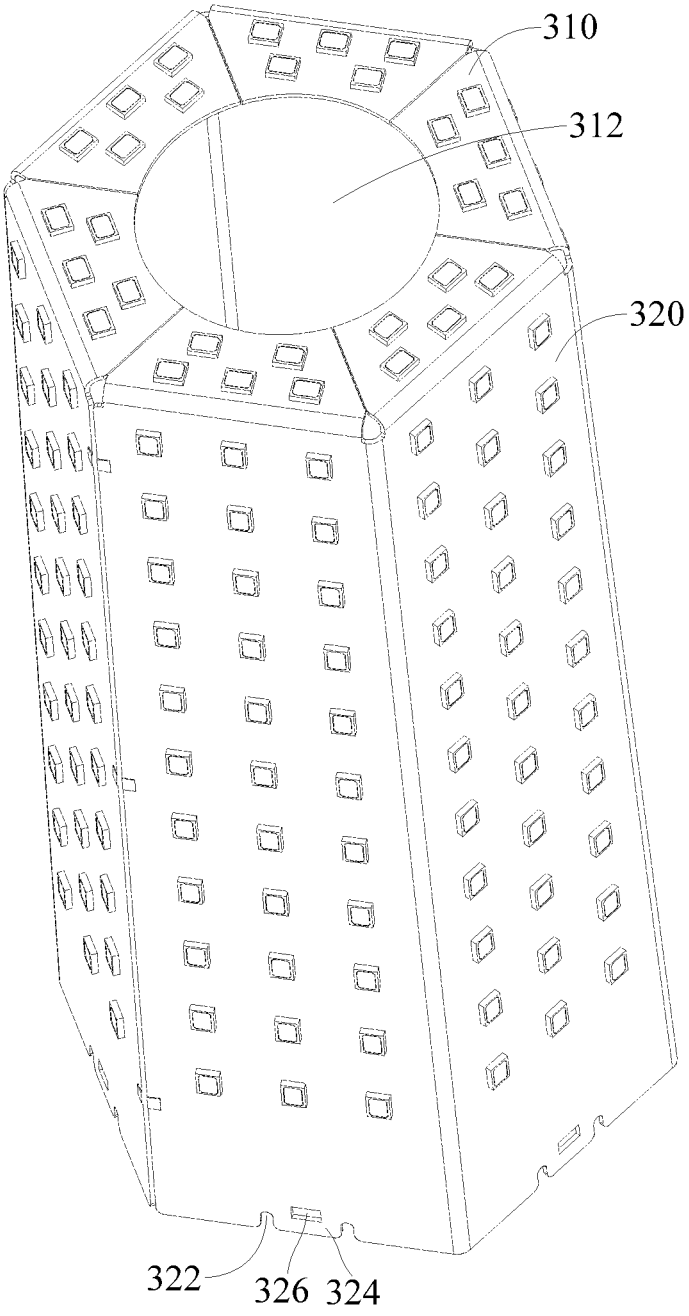
FIG. 6 is a schematic structural view of the light source substrate as shown in FIG. 5 in a first angle of view after the light source substrate is bent and enclosed.
Figure 7:
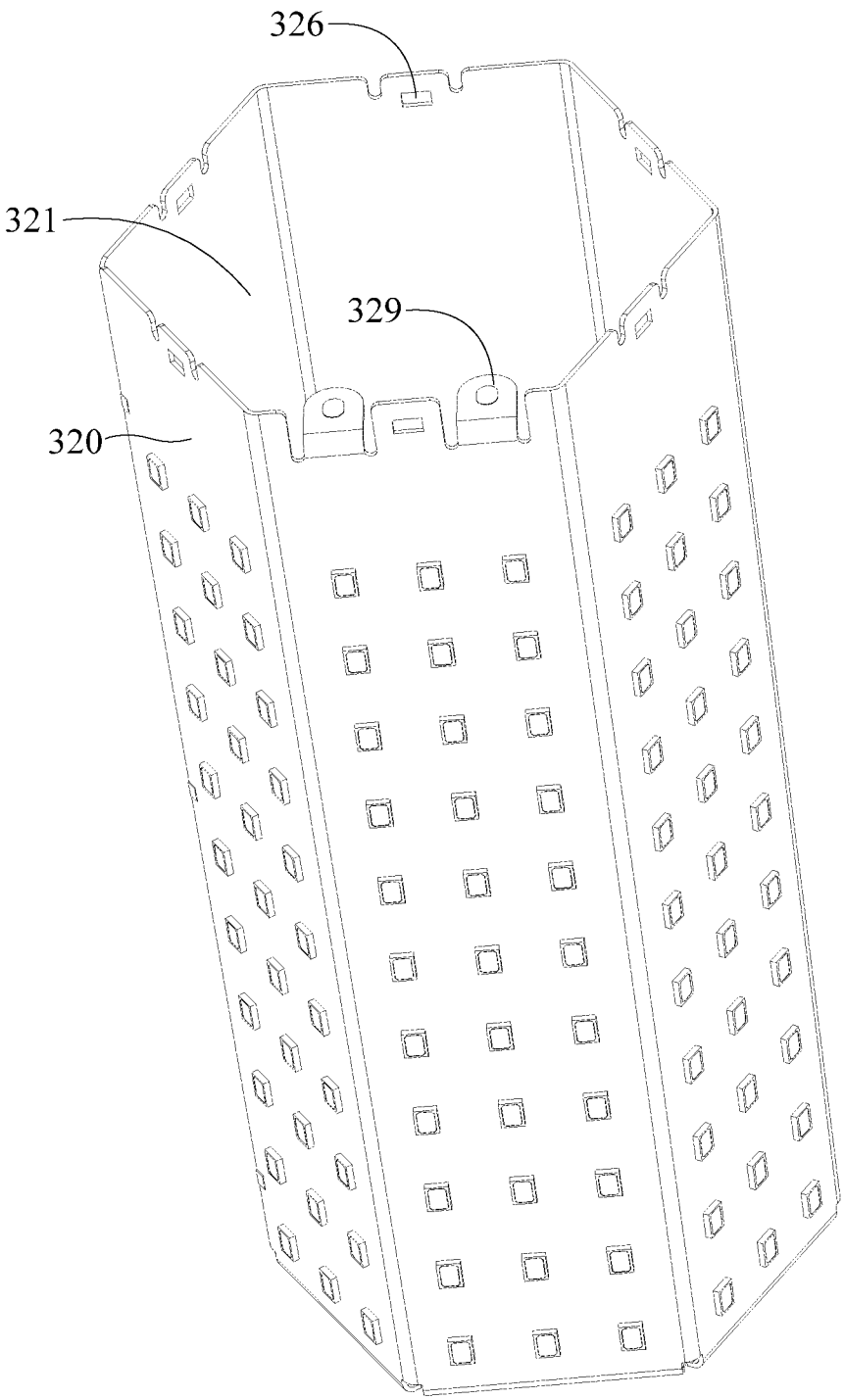
FIG. 7 is a schematic structural view of the light source substrate as shown in FIG. 5 in a second angle of view after the light source substrate is bent and enclosed.

The light source substrate 300 may be electrically connected to the power module 202. As shown in FIGS. 5-7, the light source substrate 300 may include a plurality of end-surface LED substrates 310 and a plurality of side-surface LED substrates 320 integrally connected to a side of the plurality of end-surface LED substrates 310. The plurality of end-surface LED substrates 310 and the plurality of side-surface LED substrates 320 may be bent and enclosed to form a cylindrical light emitting body and clamp with the assembling stand 200. Each of the plurality of the end-surface LED substrates 310 may be shaped like a triangle with a sector region removed from the triangle, wherein an angle of the triangle may be taken as a central angle of the sector region. The plurality of end-surface LED substrates 310 are bent and enclosed to form a circle and has a central assembly hole 312. A periphery of the plurality of end-surface LED substrates 310 may be shaped like a regular polygon such as a regular hexagon as shown in FIG. 6. Each of the side-surface LED substrates 320 may be shaped like a rectangle or a trapezoid. The plurality of side-surface LED substrates 320 may be seamlessly connected to each other and may be enclosed to form an airflow channel 321, and the power module 202 may be positioned in the airflow channel 321.

An outer end of the lamp cover 110 may be integrally formed with an embedded type downlight 113 fitting to the central assembly hole 312. The first gas port 114 may be arranged on the embedded type downlight 113, the cylindrical light emitting body sleeves and abuts against the embedded type downlight 113 through the central assembly hole 312. Outside gas may enter the airflow channel 321 through the first gas port 114.

The lamp head 400 may mate with the cover body 120 by way of screwing or clamping.

Specifically, as shown in FIGS. 5-7, each of the plurality of side-surface LED substrates 320 may be provided with a first clasp hole 326 used for clasping and fixing the assembling stand 200.

An end portion of the plurality of side-surface LED substrates 320 may be provided with a plurality of die-cutting holes 322, a plurality of clamp substrates 324 extend in the plurality of die-cutting holes 322, and the plurality of first clasp holes 326 are arranged on the plurality of clamp substrates 324.

An end portion of the side-surface LED substrate 320 may be provided with a die-cutting slot 328, and an electric contact element 329 extends in the die-cutting slot 328, wherein the electric contact element 329 may be used for bending with respect to the plurality of side-surface LED substrates 320 to form an electric connection at an end portion of the cylindrical light emitting body.

In this embodiment of the present disclosure, both the plurality of end-surface LED substrates 310 and the plurality of side-surface LED substrates 320 may include an aluminum substrate 301 and a plurality of LEDs 302 arranged on the aluminum substrate 301. The aluminum substrate 301 may have a thickness of 0.6 mm or the like, and is convenient for stamping, easy to bend, and good in heat dissipation. An ink layer and a conductive circuit may be printed on the aluminum substrate 301, which is not involved with inventive points, and thus is not described in detail.

Figure 10:
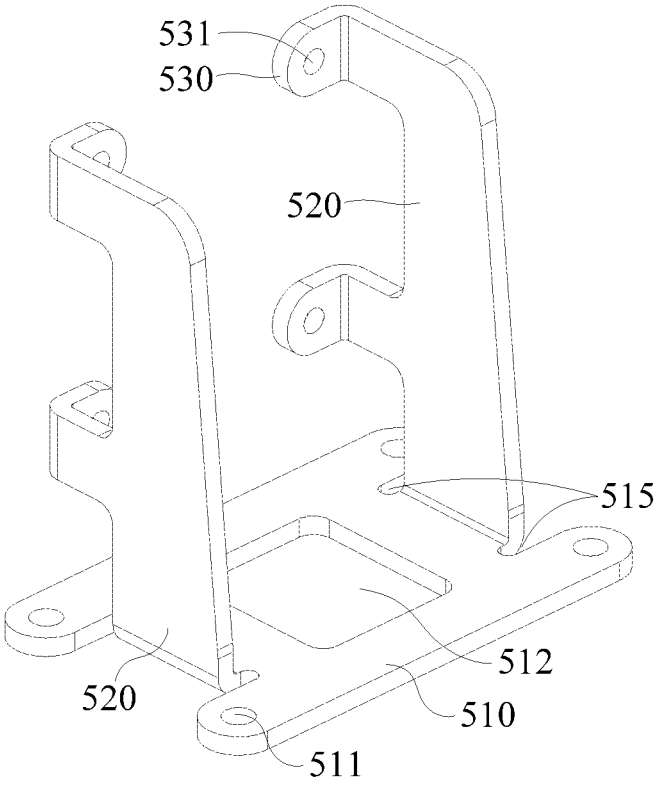
FIG. 10 is a schematic structural view of a power supply support as shown in FIG. 4.

As shown in FIG. 10, the lamp 10 may further include a power supply support 500, and the power module 202 may be fixed to the assembling stand 200 via the power supply support 500.

Specifically, the power supply support 500 may include a bottom plate 510 and a lateral plate 520. The bottom plate 510 may be used for fixing the assembling stand 200, and the lateral plate 520 may be vertically arranged with respect to the bottom plate 510. A backup plate 530 may extend on the lateral plate 520, and the backup plate 530 may be provided with a fastening hole 531 used for fastening with a bolt (not shown) and for fastening the power module 202.

Figure 8:
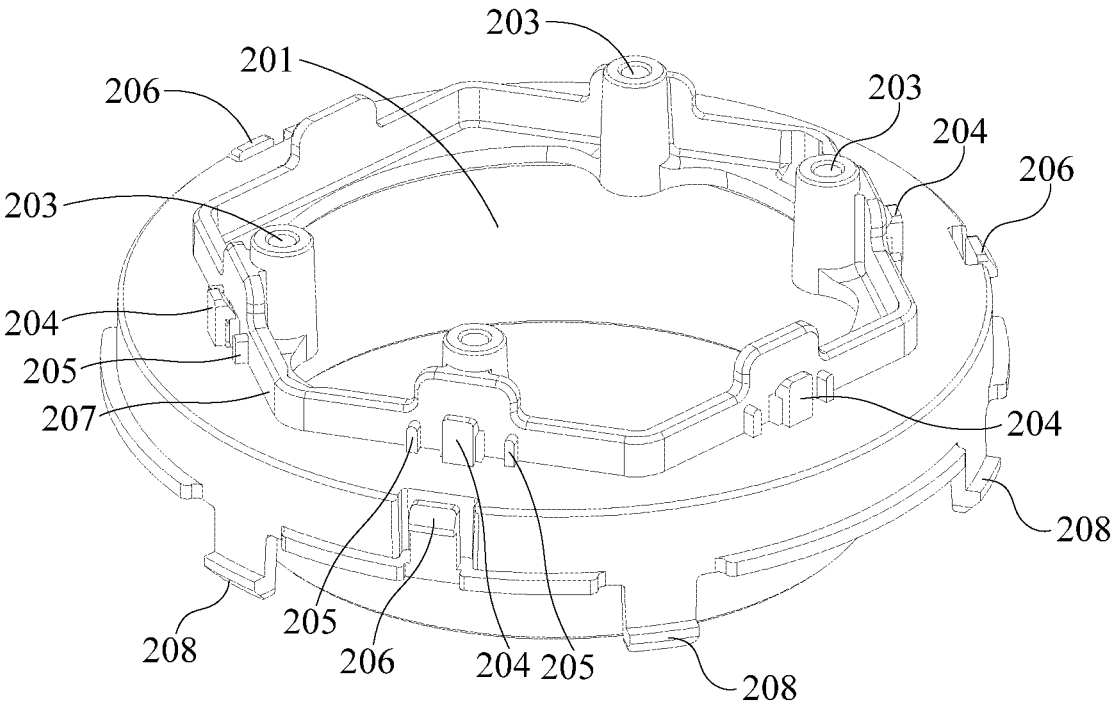
FIG. 8 is a schematic structural view of an assembling stand as shown in FIG. 4 in a first angle of view.
Figure 9:
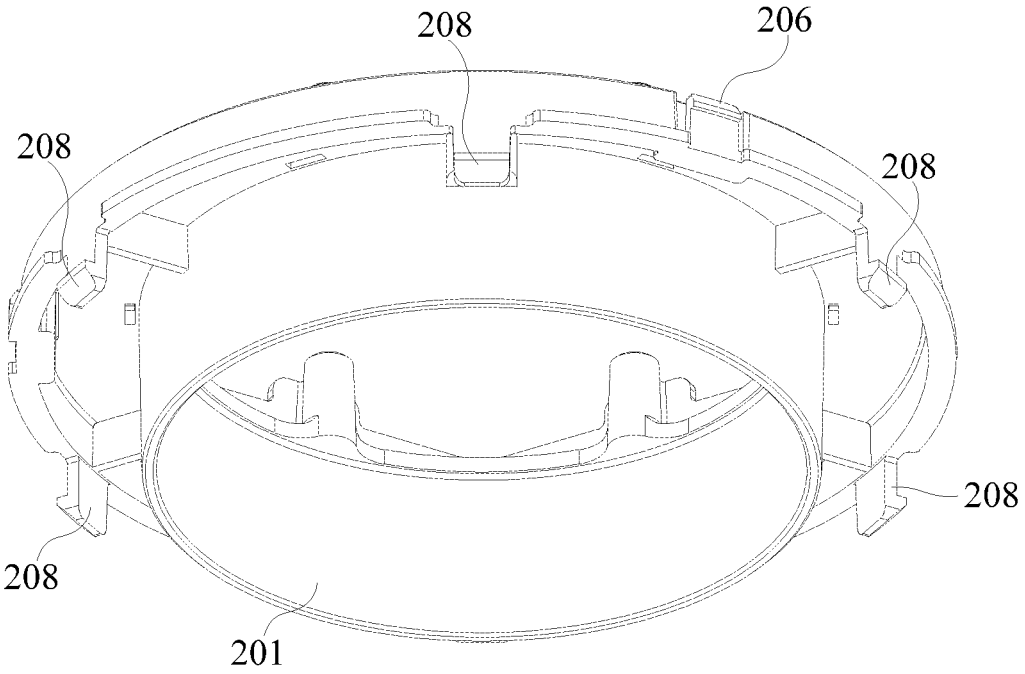
FIG. 9 is a schematic structural view of an assembling stand as shown in FIG. 4 in a second angle of view.

As shown in FIG. 8 and FIG. 9, the assembling stand 200 may include: an air duct 201, a plurality of first snap buckles 204, a plurality of second snap buckles 206, and a plurality of third snap buckles 208.

The air duct 201 may be butted to the airflow channel 321. An inner side of the air duct 201 may be provided with a plurality of first mounting studs 203 used for fixing the power supply support 500. The fan 121 may be received in the air duct 201 and may be used for attracting airflow after being energized, such that outside air flows through the first gas port 114, the airflow channel 321, the air duct 201, and the second gas port 126.

The plurality of first snap buckles 204 may be arranged on an outer ring of the air duct 201 and may be used for clamping and connecting the cylindrical light emitting body. The plurality of second snap buckles 206 may be arranged on the outer ring of the air duct 201 and may be used for clamping and connecting the lamp cover 110. The plurality of third snap buckles 208 may be arranged on the outer ring of the air duct 201 and may be used for clamping and connecting the cover body 120. In an embodiment of the present disclosure, the diameter of the plurality of first snap buckles 204 enclosed is less than that of the plurality of second snap buckles 206 enclosed and that of the plurality of third snap buckles 208 enclosed.

An inner side of the plurality of first snap buckles 204 may be provided with a barricade 207, wherein the barricade 207 forms a sleeve clearance with the plurality of first snap buckles 204 to sleeve the cylindrical light emitting body. The barricade 207 may be shaped like a regular polygon such as a regular hexagon as shown in FIG. 8, and may be used for supporting the plurality of side-surface LED substrates 320 after they are bent. An outer side surface of the barricade 207 may be further provided with a plurality of insertion pieces 205 fitting to the plurality of die-cutting holes 322.

Correspondingly, the lamp cover 110 may be provided with a plurality of second clasp holes 112 fitting to the corresponding plurality of second snap buckles 206, and the cover body 120 may be provided with a plurality of lift tables 122 fitting to the plurality of third snap buckles 208.

Figure 11:
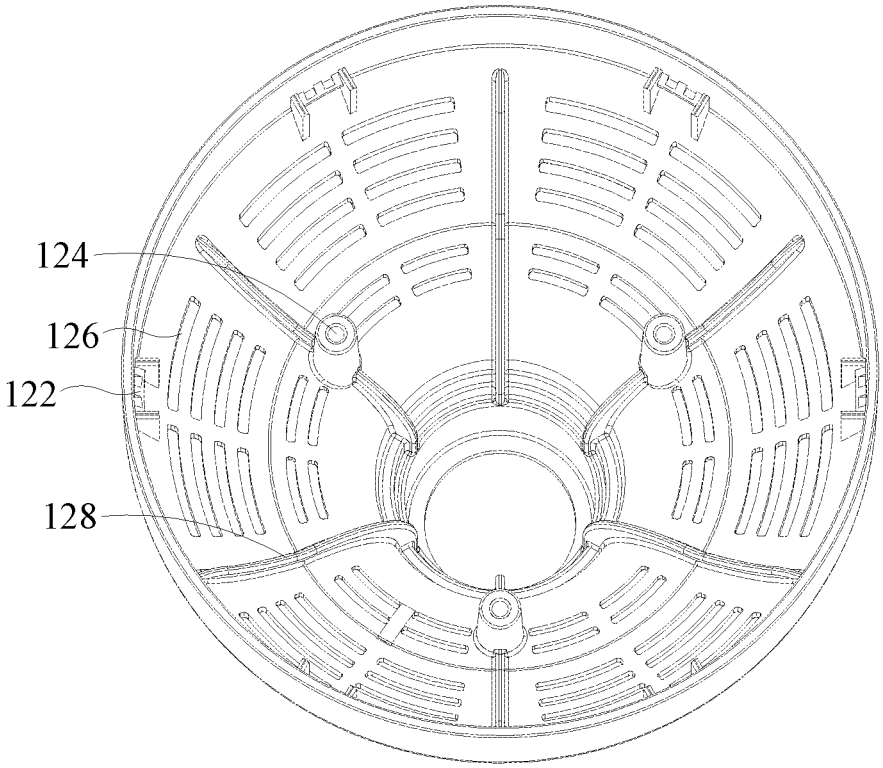
FIG. 11 is a schematic structural view of a cover body as shown in FIG. 4.

As shown in FIG. 11, an internal surface of the cover body 120 may be also provided with a plurality of second mounting studs 124 and reinforced bars 128. The fan 121 may be fixedly mounted on the plurality of second mounting studs 124 via a fan bracket 123. The plurality of reinforced bars 128 are used for reinforcing intensity of the cover body 120.

When the lamp 10 provided by the present disclosure is in operation, the fan 121 may attract outside air to enter the airflow channel 321 via the first gas port 114, such that the air removes heat generated by the cylindrical light emitting body and the power module 202 and is vented via the air duct 201 and the second gas port 126.

Referring to FIGS. 5-7, an embodiment of the present disclosure also provides a light source substrate 300. The light source substrate 300 may include a plurality of end-surface LED substrates 310 and a plurality of side-surface LED substrates 320 integrally connected to a side of the plurality of end-surface LED substrates 310. The plurality of end-surface LED substrates 310 and the plurality of side-surface LED substrates 320 may be bent and enclosed to form a cylindrical light emitting body having a central assembly hole 312.

According to a specific embodiment of the present disclosure, each of the plurality of end-surface LED substrates 310 may be shaped like a triangle with a sector region removed from the triangle, wherein an angle of the triangle may be taken as a central angle of the sector region. The plurality of end-surface LED substrates 310 are bent and enclosed to form a circle and has a central assembly hole 312.

A periphery of the plurality of end-surface LED substrate 310 may be shaped like a regular polygon such as a regular hexagon as shown in FIG. 6. Each of the plurality of side-surface LED substrates 320 may be shaped like a rectangle or a trapezoid. The plurality of side-surface LED substrates 320 may be seamlessly connected to each other and may be enclosed to form an airflow channel 321. The number of the side-surface LED substrates 320 may be six.

Each of the plurality of side-surface LED substrates 320 may be provided with a first clasp hole 326 used for clasping and fixing the assembling stand 200.

An end portion of the plurality of side-surface LED substrates 320 may be provided with a plurality of die-cutting holes 322, a plurality of clamp substrates 324 extend in the plurality of die-cutting holes 322, and the plurality of first clasp holes 326 are arranged on the plurality of clamp substrates 324.

An end portion of the side-surface LED substrate 320 may be provided with a die-cutting slot 328, and an electric contact element 329 extends in the die-cutting slot 328, wherein the electric contact element 329 may be used for bending with respect to the plurality of side-surface LED substrates 320 to form an electric connection at an end portion of the cylindrical light emitting body.

In this embodiment of the present disclosure, both the plurality of end-surface LED substrates 310 and the plurality of side-surface LED substrates 320 may include an aluminum substrate 301 and a plurality of LEDs 302 arranged on the aluminum substrate 301. The aluminum substrate 301 may have a thickness of 0.6 mm or the like, and is convenient for stamping, easy to bend, and good in heat dissipation. An ink layer and a conductive circuit may be printed on the aluminum substrate 301, which is not involved with inventive points, and thus is not described in detail.

An embodiment of the present disclosure also provides a lamp 10, which may include the foregoing light source substrate 300.

Referring to FIG. 8 and FIG. 9, the present disclosure also provides an assembling stand 200. As an integrally-molded structure, the assembling stand 200 may include an air duct 201, a plurality of first snap buckles 204, a plurality of second snap buckles 206, and a plurality of third snap buckles 208.

The air duct 201 may be butted to the airflow channel 321. An inner side of the air duct 201 may be provided with a plurality of first mounting studs 203 used for fixing the power supply support 500. The air duct 201 may be used for receiving the fan 121.

The plurality of first snap buckles 204 may be arranged on an outer ring of the air duct 201 and may be used for clamping and connecting the cylindrical light emitting body. The plurality of second snap buckles 206 may be arranged on the outer ring of the air duct 201 and may be used for clamping and connecting the lamp cover 110. The plurality of third snap buckles 208 may be arranged on the outer ring of the air duct 201 and may be used for clamping and connecting the cover body 120. In an embodiment of the present disclosure, the diameter of the plurality of first snap buckles 204 enclosed is less than that of the plurality of second snap buckles 206 enclosed and that of the plurality of third snap buckles 208 enclosed.

In this embodiment of the present disclosure, an inner side of the plurality of first snap buckles 204 may be provided with a barricade 207, wherein the barricade 207 forms a sleeve clearance with the plurality of first snap buckles 204 to sleeve the cylindrical light emitting body. The barricade 207 may be shaped like a regular polygon such as a regular hexagon as shown in FIG. 8, and may be used for supporting the plurality of side-surface LED substrates 320 after they are bent. An outer side surface of the barricade 207 may be further provided with a plurality of insertion pieces 205 fitted to the plurality of die-cutting holes 322. The plurality of insertion pieces 205 may be used for engaging the cylindrical light emitting body.

The present disclosure also provides a lamp 10, which may include the foregoing assembling stand 200.

Referring to FIG. 10, the present disclosure may also provide a power supply support 500. The power supply support 500 may include a bottom plate 510 and a lateral plate 520 which are integrally connected. The bottom plate 510 may be used for fixed installation, the lateral plate 520 may be vertically bent with respect to the bottom plate 510, and the lateral plate 520 may be used for fastening the power module 202.

The bottom plate 510 may be provided with at least one pair of cutting grooves 515, and the lateral plate 520 may be positioned between the cutting grooves 515.

In an embodiment, the bottom plate 510 may be symmetrically provided with two pairs of cutting grooves 515. Two lateral plates 520 may be symmetrically arranged.

A periphery of the bottom plate 510 may be provided with a plurality of fixing holes 511, which may be threaded holes or through holes.

The bottom plate 510 may be also provided with a heat-radiating opening 512. When the power module 202 is fixedly mounted via the lateral plate 520, the power module 202 and the heat-radiating opening 512 are arranged at intervals.

Backup plates 530 may extend on the lateral plate 520, the power module 202 may be fastened by the backup plates 530, and the backup plates 530 may be vertically arranged with respect to the lateral plate 520. The number of the backup plates 530 may be four, and each of the backup plates 530 may be provided with a fastening hole 531.

The present disclosure also provides a lamp 10, which may include the foregoing power supply support 500.

In conclusion, those skilled in the art may easily understand that the lamp 10 and the light source substrate 300 thereof, the assembling stand 200 and the power supply support 500 provided by the present disclosure are simple in structure, good in heat dissipation, convenient for manufacturing, unnecessary for welding connection, and easy for assembling. Therefore, production difficulties and costs are greatly reduced.

The above are merely embodiments of the present disclosure and are not intended to limit the patent scope of the present disclosure. Any modifications of equivalent structure or equivalent process made on the basis of the contents of the description and accompanying drawings of the present disclosure or directly or indirectly applied to other related technical fields shall similarly fall within the scope of patent protection of the present disclosure.

What is claimed is:

1. A lamp fitting, comprising:

a receiving body, comprising a lamp cover and a cover body, wherein the lamp cover is provided with a first gas port, the cover body is provided with a second gas port, and the lamp cover is provided with an open end;

an assembling stand inserted into the lamp cover through the open end, wherein the assembling stand is used for assembling a power module and receiving a fan;

a light source substrate electrically connected to the power module, wherein the light source substrate comprises a plurality of end-surface LED substrates and a plurality of side- surface LED substrates integrally connected to a side of the plurality of end-surface LED substrates, and the plurality of end-surface LED substrates and the plurality of side-surface LED substrates are bent and encircled to form a cylindrical light emitting body and clamp with the assembling stand; and a lamp head mating with the cover body, wherein an end portion of the side-surface LED substrate is provided with a die-cutting slot, an electric contact element extends in the die-cutting slot, and the electric contact element is used for bending with respect to the side-surface LED substrate to form an electric connection at an end portion of the cylindrical light emitting body.

2. The lamp fitting according to claim 1, wherein each of the plurality of end-surface LED substrates is shaped like a triangle with a sector region removed from the triangle, wherein an angle of the triangle is taken as a central angle of the sector region, the plurality of end-surface LED substrates are bent and encircled to form a central assembly hole.

3. The lamp fitting according to claim 2, wherein an outer end of the lamp cover is integrally formed with an embedded type downlight fitting to the central assembly hole, the first gas port is arranged on the embedded type downlight, the cylindrical light emitting body sleeves and abuts against the embedded type downlight through the central assembly hole.

4. The lamp fitting according to claim 1, wherein each of the plurality of side-surface LED substrates is shaped like a rectangle or a trapezoid.

5. The lamp fitting according to claim 1, wherein the plurality of side-surface LED substrates are seamlessly connected to each other and are encircled to form an airflow channel, and the power module is positioned in the airflow channel.

6. The lamp fitting according to claim 1, wherein each of the plurality of side- surface LED substrates is provided with a first clasp hole used for clasping and fixing the assembling stand.

7. The lamp fitting according to claim 6, wherein an end portion of the plurality of side-surface LED substrates are provided with a plurality of die-cutting holes, a plurality of clamp substrates extend in the plurality of die-cutting holes, and the plurality of first clasp holes are arranged on the plurality of clamp substrates.

8. The lamp fitting according to claim 1, wherein both each of the plurality of end-surface LED substrates and each of the plurality of side-surface LED substrates comprise an aluminum substrate and a plurality of LEDs arranged on the aluminum substrate.

9. The lamp fitting according to claim 1, further comprising a power supply support, and the power module is fixed to the assembling stand via the power supply support.

10. The lamp fitting according to claim 9, wherein the power supply support comprises a bottom plate and a lateral plate, the bottom plate is used for fixing the assembling stand, the lateral plate is vertically arranged with respect to the bottom plate, a backup plate extends on the lateral plate, the backup plate is provided with a fastening hole used for being fastened by a bolt and for fastening the power module.

11. The lamp fitting according to claim 7, wherein the assembling stand comprises:

an air duct, the fan being received in the air duct a plurality of first snap buckles arranged on an outer ring of the air duct, wherein the plurality of first snap buckles are used for clamping and connecting the cylindrical light emitting body;

a plurality of second snap buckles arranged on the outer ring of the air duct, wherein the plurality of second snap buckles are used for clamping and connecting the lamp cover; and a plurality of third snap buckles arranged on the outer ring of the air duct, wherein the plurality of third snap buckles are used for clamping and connecting the cover body.

12. The lamp fitting according to claim 11, wherein an inner side of the plurality of first snap buckles is provided with a barricade, the barricade forms a sleeve clearance with the plurality of first snap buckles to sleeve the cylindrical light emitting body.

13. The lamp fitting according to claim 12, wherein the barricade is shaped like a regular polygon and is used for supporting inside an encircled state formed after a plurality of side-surface LED substrates are bent, and the barricade is further provided with a plurality of insertion pieces fitting to the plurality of die-cutting holes.

14. The lamp fitting according to claim 11, wherein the lamp cover is provided with a plurality of second clasp holes fitting to the plurality of second snap buckles, and the cover body is provided with a plurality of lift tables fitting to the plurality of third snap buckles.

15. A light source substrate, comprising a plurality of end-surface LED substrates and a plurality of side-surface LED substrates integrally connected to a side of the plurality of end-surface LED substrates, wherein the plurality of end-surface LED substrates and the plurality of side-surface LED substrates are bent and encircled to form a cylindrical light emitting body having a central assembly hole, wherein each of the plurality of side-surface LED substrates is provided with a first clasp hole used for clasping and fixing; and an end portion of the side-surface LED substrate is provided with a die-cutting slot, an electric contact element extends in the die-cutting slot, and the electric contact element is used for bending with respect to the side-surface LED substrate to form an electric connection at an end portion of the cylindrical light emitting body.

16. The light source substrate according to claim 15, wherein each of the plurality of end-surface LED substrates is shaped like a triangle with a sector region removed from the triangle, wherein an angle of the triangle is taken as a central angle of the sector region, the plurality of end-surface LED substrates are bent and encircled to form the central assembly hole.

17. The light source substrate according to claim 15, wherein an end portion of the plurality of side-surface LED substrates are provided with a plurality of die-cutting holes, a plurality of clamp substrates extend in the plurality of die-cutting holes, and the plurality of first clasp holes are arranged on the plurality of clamp substrates.

* * * * *